US006213824B1

(12) United States Patent
Small

(10) Patent No.: US 6,213,824 B1
(45) Date of Patent: Apr. 10, 2001

(54) METHOD FOR REDUCING VESSEL DRAFT

(75) Inventor: Mark S. Small, Delray Beach, FL (US)

(73) Assignee: Power Vent Technologies, Inc., Pompano Beach, FL (US)

( * ) Notice: Subject to any disclaimer, the term of this patent is extended or adjusted under 35 U.S.C. 154(b) by 0 days.

(21) Appl. No.: 09/504,770

(22) Filed: Feb. 11, 2000

(51) Int. Cl.[7] ..... B63H 5/16
(52) U.S. Cl. ..... 440/68; 114/288; 114/291
(58) Field of Search ..... 114/271, 274, 114/288, 291; 440/68, 69, 66, 70

(56) References Cited

U.S. PATENT DOCUMENTS 4,015,556 * 4/1977 Bordiga ..... 440/69
4,391,593 * 7/1983 Whitworth ..... 440/70
4,609,360 * 9/1986 Whitehead ..... 440/69
4,655,157 * 4/1987 Sapp ..... 114/291
4,689,026 * 8/1987 Small ..... 440/66
4,977,845 * 12/1990 Rundquist ..... 114/289

* cited by examiner

*Primary Examiner*—Stephen Avila
(74) *Attorney, Agent, or Firm*—McHale & Slavin

(57) ABSTRACT

An improved method for raising a propeller up into the hull of a marine water craft for the purpose of reducing the likelihood of underwater impact and improving shallow water operation without encountering the high efficiency losses normally associated with shallow draft drive systems or water jets. It utilizes a unique tunnel which is open bottomed and extends longitudinally in the running surface of the hull. The lead in to the tunnel, which is termed the "chute" forms the entry to a deeper portion of the tunnel located further aft. A super-cavitating propeller is positioned in the aft tunnel section. The propeller is raised vertically into the tunnel such that the propeller blade tips can be above, below or flush with the running surface of the hull but the prop shaft is always above the running surface of the hull. The invention relates to the longitudinal position of the chute with respect to the propeller, the general shape of the chute and its normal method of operation.

7 Claims, 4 Drawing Sheets

METHOD FOR REDUCING VESSEL DRAFT

FIELD OF THE INVENTION

This invention is directed to the field of water craft, and in particular to a method for reducing vessel draft of tunnel mounted surface piercing propellers.

BACKGROUND OF THE INVENTION

The desire for propulsion systems which have little or no draft is a universal need. Water jets and surface drives are two embodiments of marine propulsion systems which have shallow draft as one of their defining characteristics.

Jets are essentially water pumps that have been fitted into water craft. Water is brought into the an inlet which is generally composed of an upswept bend which lifts the water and another bend changes its direction and brings it to the face of the impeller. The impeller increases the pressure in the water column which is needed to expel the water through a nozzle. This event produces thrust to propel the craft.

However, water jets have always been relatively inefficient when compared to open propellers and efforts to improve their efficiency over the last 30 years have met with limited success. Top speed is still well below the normal attainment of simple open propellers.

Air ingestion is also a problem when rough seas are encountered. Jets generate pressure by slightly compressing the water they intake. This makes them sensitive to relatively small amounts of air in the incoming stream. Pratt & Whitney testing showed that when air volumes in the inlet flow are just a few percent of the total inlet flow, pump efficiency drops off dramatically. In normal use in heavy seas air ingestion is difficult if not impossible to eliminate from the inlet and so jets tend to unload when air is ingested and lose thrust. To combat this problem the inlets so jets tend to be kept as short as possible but often this length deficiency hurts performance due to excessive separation or turbulence in the inlet stream capture volume.

Surface drives are another way to reduce draft by bringing the propeller up vertically and operating it with only partial submergence. While submergence varies, 50% of the propeller diameter is a good average. In fixed surface drives steering is accomplished through the use of a rudder behind the propeller just like an inboard. In moveable shaft systems the propeller can be steered and trimmed for improved high speed operation.

Unlike jets, surface drives have excellent efficiency. Efficiencies as high as 85% have been documented for inclined shaft, 50% submerged super-cavitating propellers. Inclined super-cavitating propellers are the most efficient form of marine propulsion known.

What is lacking is a product which takes the speed advantages and efficiency of surface drives and joins them with the shallow draft and protection from underwater impact damage afforded by water jets.

A significant amount of prior art exists which relates to raising the propeller of a marine vessel vertically up into the hull for the purpose of avoiding or minimizing impact with an underwater obstruction.

The surface drive, invented by Hickman in his U.S. Pat. No. 1,044,176 dated Nov. 12, 1912 sought to raise the propeller of a conventional inboard up vertically to as to reduce appendage drag and improve top speed. Many ideas followed with different approaches to utilizing the basic advantages of surface drives. Many of these concepts extend the propeller out the stem of the boat in either a fixed shaft mechanism or a moveable shaft mechanism but some designers sought to bring the surfacing propeller forward of the transom and into the hull into what is generally termed the tunnel.

Once this evolution became accepted designers sought ways to further reduce the amount of propeller which extends below the bottom of the hull without paying a performance penalty. Unfortunately, a performance penalty is always paid if the propeller requires incoming water to be lifted up vertically in order to operate.

Generally when a surfacing or super-cavitating propeller is brought up into a tunnel, the tunnel is at least partially filled with air. When air is introduced into the hull channel ahead of the propeller there are often methods for controlling the source, point of introduction and amount of air.

Examples of tunnel systems which are air in a tunnel with a super-cavitating propeller can be found in prior art such as U.S. Pat. Nos. 1,534,725; 3,604,385; 3,745,963; 3,793,978; 4,015,556; 4,027,613; 4,371,350; 4,406,635; 4,655,157; 4,689,026; 4,941,423; 4,977,845, U.S. Pat. No. 1,534,725 by Macmillan shows a set of counter-rotating propellers (van wheels) which operate in a cavity which is filled with pressurized air to maintain the level of water in the cavity desired. Macmillan does not raise the propeller blades above the propeller which is approximately 40–50% submerged. Macmillan also does not propose a hull channel to feed the propeller water.

U.S. Pat. No. 3,604,385, High Speed Water Craft by Mickleover concerns a high speed water craft which utilizes a tunnel with a propeller disposed longitudinally inside the tunnel. Mickleover states that the forward portion of the tunnel rises clear of the water level when the craft is on plane to admit air into the tunnel and relieve the suction from underneath the hull. While there is a secondary source of air for relieving the suction (the engines exhaust) it is clearly understood that the primary source of air to ventilate the tunnel is coming directly into the front of the tunnel cavity when the forward portion of the tunnel rises clear of the natural water surface.

The current invention seeks just the opposite of Mickleover by preventing air from entering the hull channel from the front of the boat. Unlike Mickleover it is the intent of this patent to have the abrupt wall located in the tunnel to be positioned below the surface of the water under normal operation and to achieve this we position the step in the tunnel further aft, closer to the propeller and lower, vertically so that under normal conditions the step in the hull channel is under water due to the normal submergence of the hull when on plane. This is important to understand. The Mickleover approach fails to control the submergence of the propeller in rough water conditions. Waves traveling down the forward tunnel section will cause uneven loading of the propeller.

U.S. Pat. No. 3,745,963 by Fischer has propellers in cavities in the hull with the tunnel aft of the top half of the propellers and the propeller shafts extending below the running surface of the hull.

U.S. Pat. No. 3,793,980, by Sherman, details a tunnel mounted super-cavitating propeller which is positioned with approximately half of the propellers effective diameter below the running surface of the hull. At slow speed the tunnel is filled with water which is pulled up into the tunnel through a series of slots located in front of the propeller. U.S. Pat. No. 4,027,613 by Wollard shows a stepped hull with a surfacing propeller aft of the step. No hull channel exists for feeding the surfacing propeller.

U.S. Pat. No. 4,057,027 by Foster shows a super-cavitating propeller in a pocket near the stem with a short water supply duct.

U.S. Pat. No. 4,406,635 by Wuhrer seeks to improve the construction of the mechanism which is used to move the flow control plate in the Kruppa patent.

U.S. Pat. No. 4,655,157 by Sapp shows a stepped hull which pivots at the trailing edge of the running surface located some distance fore of midship. There is no hull channel to feed water to the super-cavitating propeller.

U.S. Pat. No. 4,689,026 by Small shows a super-cavitating propeller in a tunnel with air. There is no hull channel feeding the propeller water. The position of the propeller is approximately 50% submerged.

U.S. Pat. No. 4,977,845 by Rundquist builds on the concept by Kruppa and Wurher to control propeller submergence and boat handling with movable flaps.

SUMMARY OF THE INVENTION

The present invention is related to a marine propulsion system which is disposed in a tunnel that runs longitudinally in the bottom of a marine water craft. The invention provides a method for raising a propeller up into the hull of a marine water craft for the purpose of reducing the likelihood of underwater impact and improving shallow water operation without encountering the high efficiency losses normally associated with shallow draft drive systems or water jets. It utilizes a unique tunnel which is open bottomed and extends longitudinally in the running surface of the hull. The lead in to the tunnel, which is termed the "chute" forms the entry to a deeper portion of the tunnel located further aft. A super-cavitating propeller is positioned in the aft tunnel section. The propeller is raised vertically into the tunnel such that the propeller blade tips can be above, below or flush with the running surface of the hull but the prop shaft is always above the running surface of the hull. The invention relates to the longitudinal position of the chute with respect to the propeller, the general shape of the chute and its normal method of operation.

One object of the invention is to supply a stream of water, of sufficient quantity and suitable cross sectional shape to efficiently operate with a super-cavitating propeller.

An object of this invention is that under normal operation the water is supplied in the correct position to the propeller without raising the water.

It is another object of this invention to efficiently channel the incoming water up, vertically, to engage the super-cavitating propeller and to keep this channeled water free of air under normal operation.

Another object of this invention is to accomplish all of these improved attributes without complex movable surfaces in the tunnel or chute.

Another object of the invention is that the propeller is higher, vertically, in the tunnel than what would be considered normal operation where normal operation for a surfacing propeller is defined herein as having approximately 50% of the diameter of the propeller below the primary running surface of the hull.

An alternative method consists of a shroud around the propeller for protection. A further method incorporates a guard that protects the system from damage.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 5:
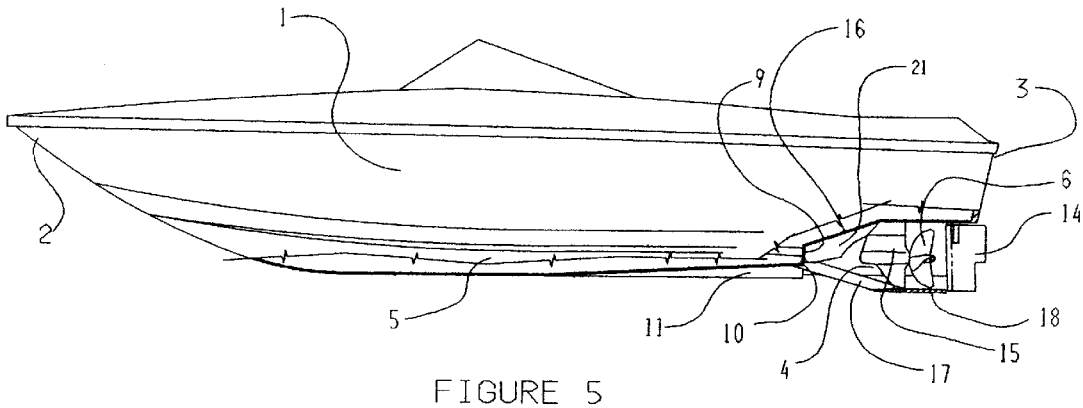
FIG. 5 is same as FIG. 4 showing a gear case with propeller.
Figure 6:
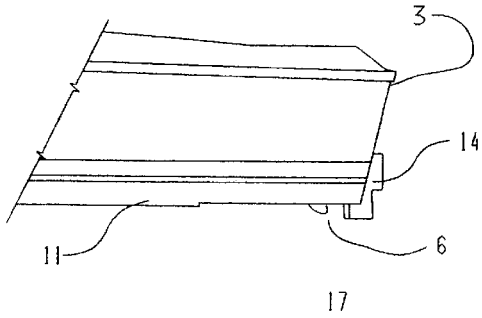
FIG. 6 is aft portion of hull without shroud and guard.
Figure 7:
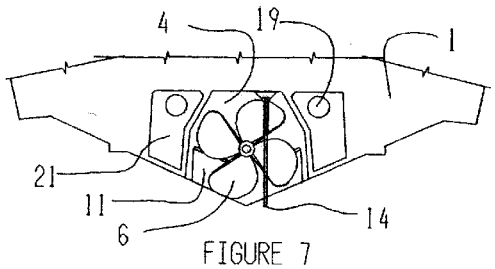
FIG. 7 is aft view of FIG. 6.
Figure 8:
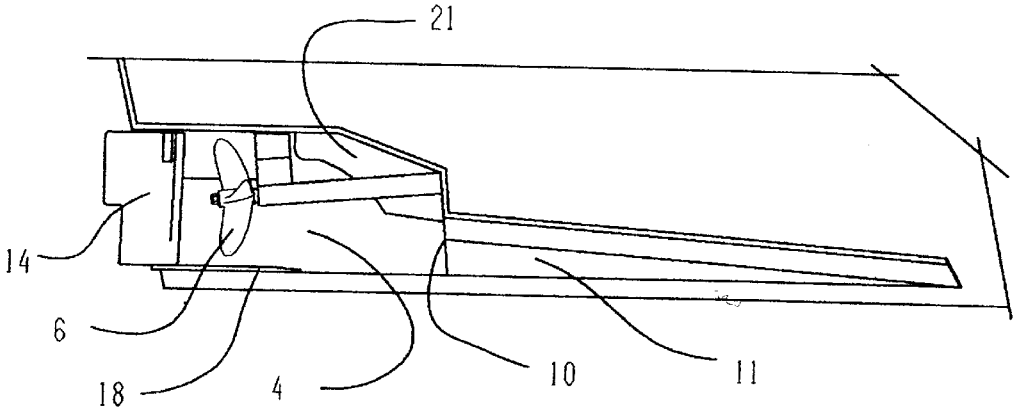
FIG. 8 is a side cutaway of a twin application.
Figure 9:
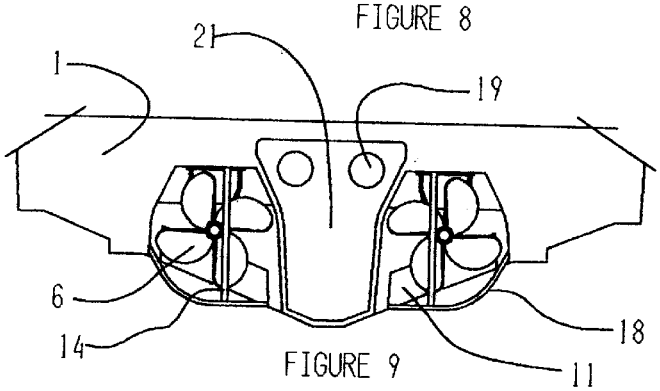
FIG. 9 is a aft view of FIG. 8.
Figure 10:
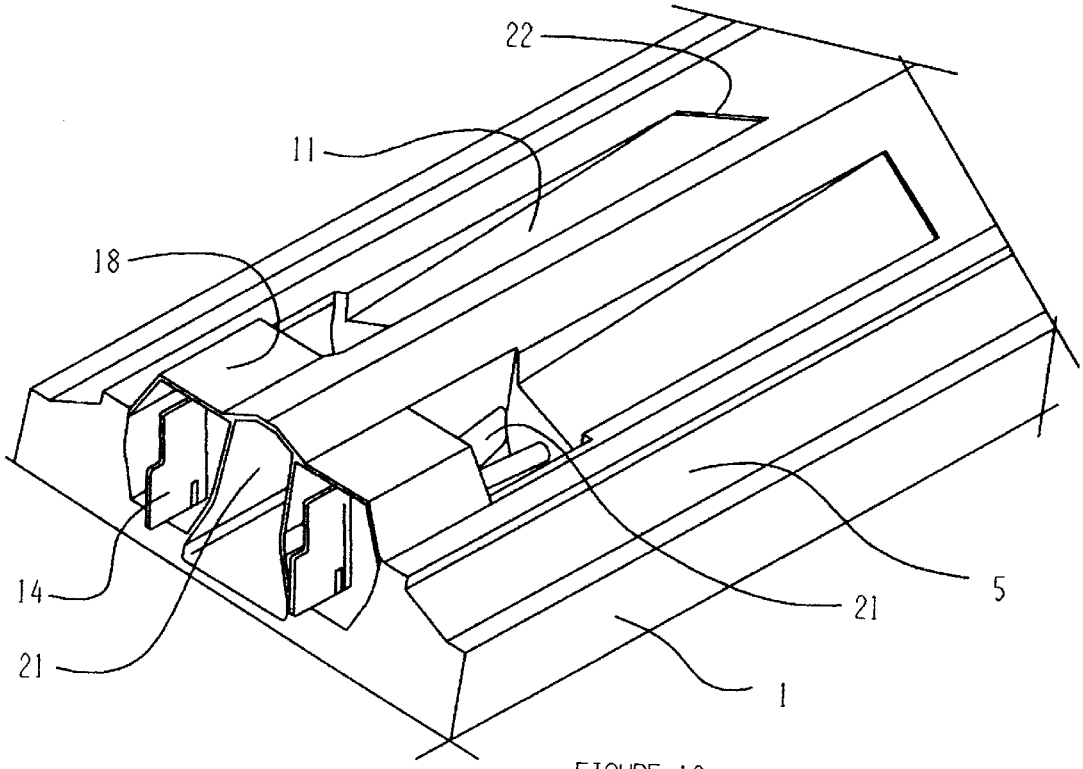
FIG. 10 is an isometric bottom view of FIG. 8.

In a water craft (1) having a bow (2) and a stem (3) the general shape of which are relatively unimportant, with a tunnel (4) which runs longitudinally fore and aft in the running surface (5) of the hull. While the shape of the tunnel shown is approximately square the invention related to other shapes as well. Within the tunnel is positioned a super-cavitating propeller (6) which can be secured with a strut (7) and shaft (8) arrangement or any other suitable arrangement such as a gear-case (15) in FIG. 5, which can secure the propeller in the desired position in the tunnel. The tunnel extends from the stem of the vessel (3) forward toward the bow for a certain distance. measured from forward most face of the propeller. For this distance the tunnel is relatively unchanged in its basic cross section which is octagonal, rectangular or square but could be semi-circular as well. After the defined distance the tunnel has an abrupt change in cross section with the inclusion of a vertical of nearly vertical wall (9). This wall should have a relatively sharp trailing edge radius (10) for the purpose of breaking the incoming water stream free from attachment. As long as the water breaks free the shape of this wall can be sloped aft (16) to provide improved reverse performance. The inlet chute (11) begins at this point (10) and is disposed from this point forward towards the bow (1).

The chute is defined in cross section as a channel which opens downward and is generally rectangular with a width (12) which is less than 2 times the propeller diameter and a depth (13) which is less than one propeller diameter. While shown as roughly rectangular other shapes will perform as well.

Figure 1:
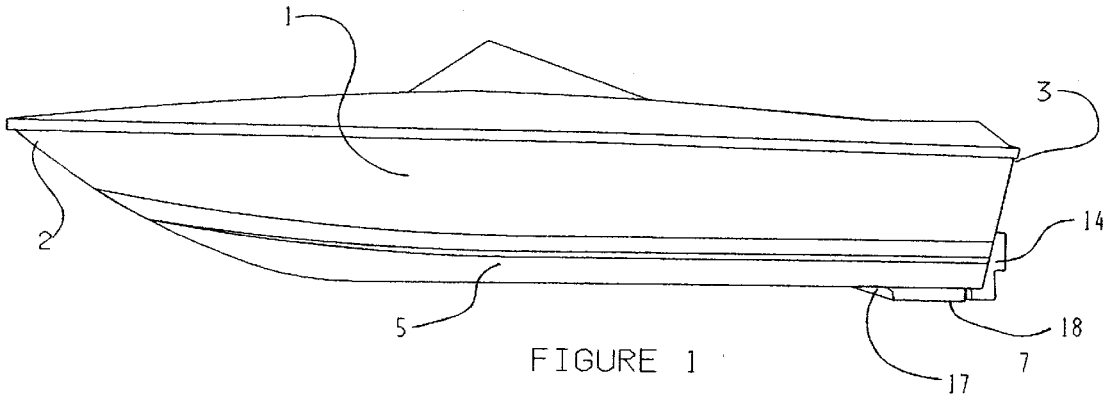
FIG. 1 is a pictorial side view of a vessel having a tunnel mounted surface piercing propeller with chute, shroud and guard.
Figure 2:
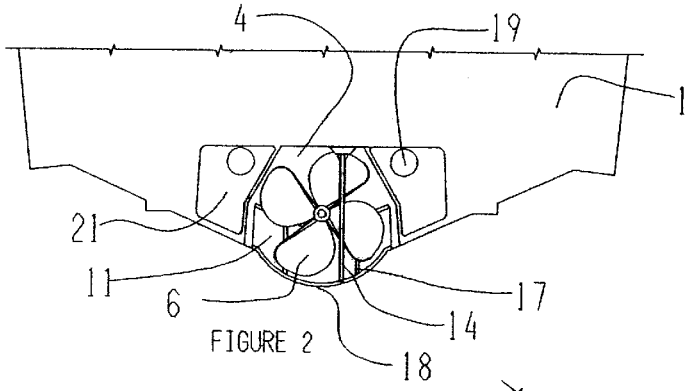
FIG. 2 is a stem view of FIG. 1.
Figure 3:
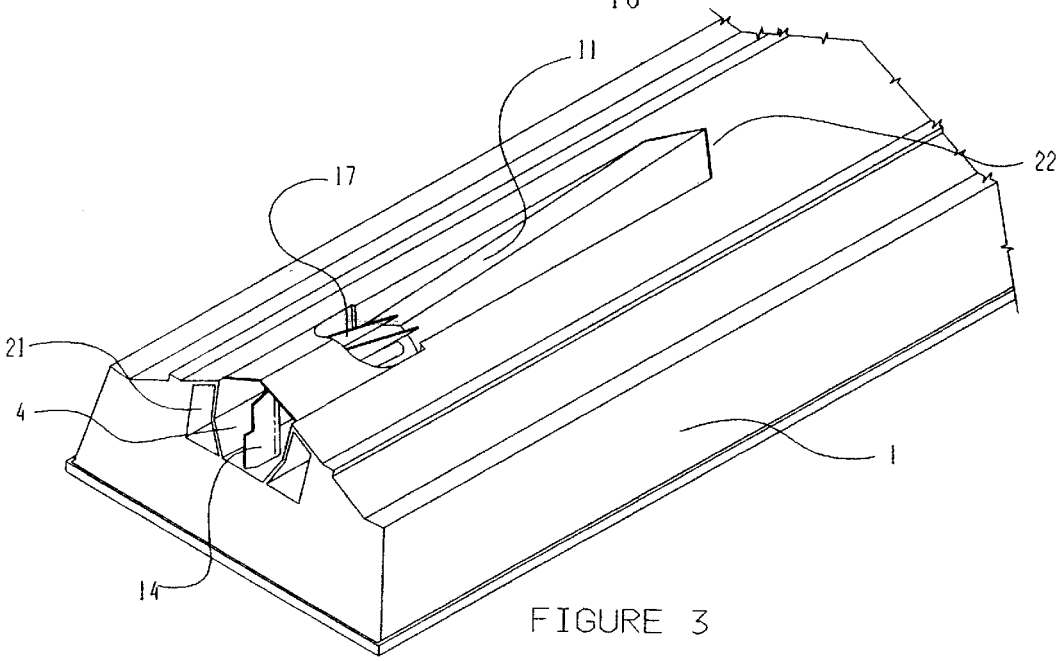
FIG. 3 is an isometric bottom view of FIG. 1.
Figure 4:
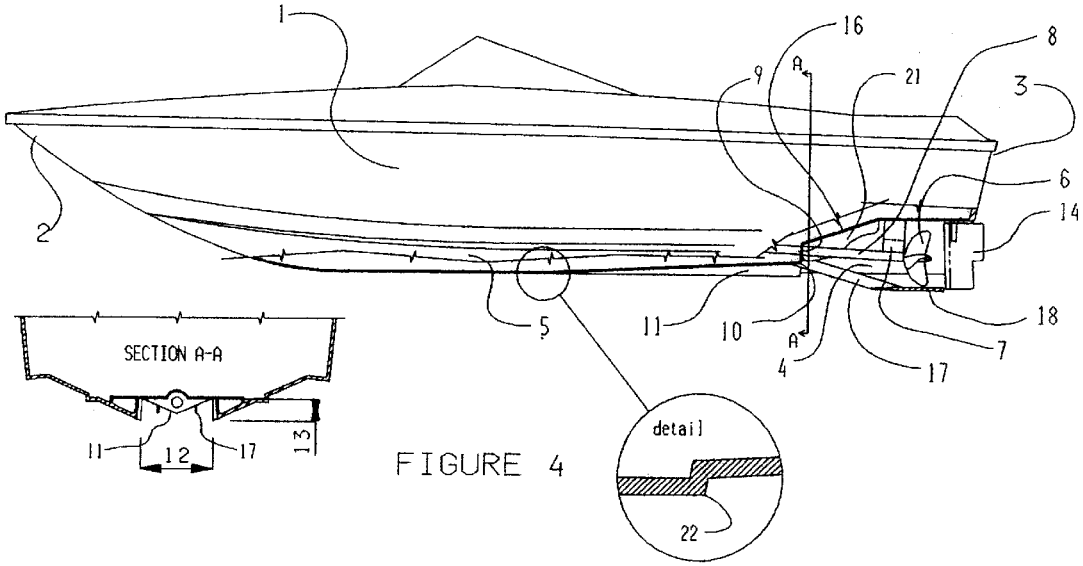
FIG. 4 is a side view cut away to show chute, shroud and guard; section showing chute: detail showing micro-step.
Figure 11:
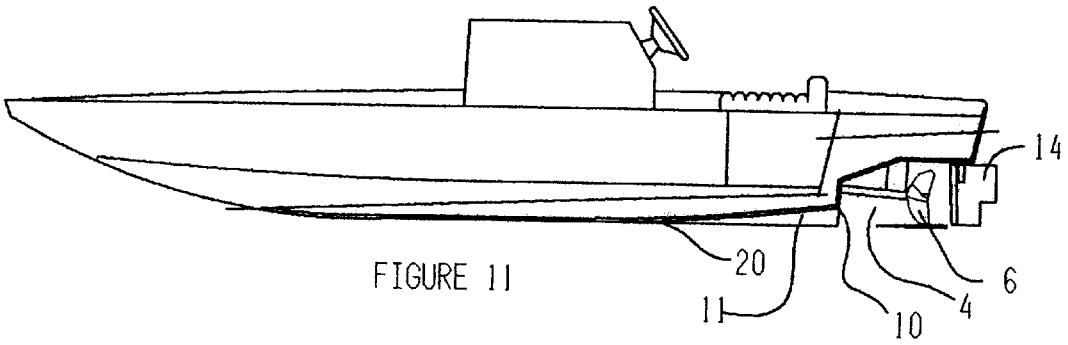
FIG. 11 is side view of a small craft showing curved inlet chute.
Figure 12:
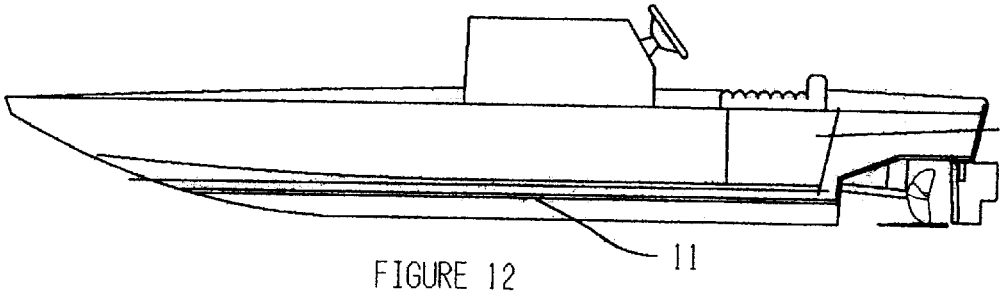
FIG. 12 is side view of a small craft showing chute parallel to keel.

In longitudinal section the chute may employ different shapes. The inlet configuration has differing forms according to the application. The inlet of the chute in a craft similar to FIG. 4 could have a faired transition or a microstep (22) as in the detail of FIG. 4. This microstep allows the water to break free and reattach as it passes this discontinuity in the hull. For hulls of very high speed, light weight and relatively short overall length as shown in FIG. 11, it will be difficult to keep the chute exit (10) under water when the craft is running at top speed because as vessels go faster the wetted keel or the amount of the hull which is actually in the water continues to decrease. In this case, the chute will of necessity be curved (20) FIG. 11, to utilize the Coanda effect to lift the incoming stream of water as shown in FIG. 11. In FIG. 12, when the combination of speed, weight and length are such that adequate free surface submergence exists such that the roof of the chute (11) is impacting incoming water under normal running conditions then the curved inlet chute would be abandoned for one that is straight with the preferred embodiment being a chute roof which is parallel to the keel. In this manner the inlet chute becomes a lifting surface because the free stream water which is at rest relative to the vessel simply enters the chute and impacts its upper surface, creating lift. It then flows down the cute and into the tunnel cavity. Unlike curved inlets on jets which are significant sources of drag this straight inlet chute minimizes pressure and form drag and does not have to lift any water.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A method for reducing the draft of a water vessel and supplying water flow to a surfacing propeller comprising:

A) providing a vessel with a hull having a bow, stem, keel and a surfacing propeller turned by a propeller shaft, said vessel having a bottom running surface defining the draft;

B) providing a downwardly opening tunnel in said keel extending from said stem toward said bow, said tunnel having a roof and depending side walls, said tunnel having a chute section toward said bow, said chute section being of lesser cross section than said tunnel, said chute and said tunnel separated by an abrupt change in cross section;

C) reducing the draft of said vessel by placing said surfacing propeller in said tunnel, said propeller shaft located above said running surface;

D) turning said propeller shaft to provide forward headway to said vessel; and

E) providing a stream of water through said chute, said stream having the same cross section as said chute whereby said stream is free of air and of sufficient quantity to efficiently operate said surfacing propeller.

2. The method of claim 1 wherein said roof is oriented parallel to said keel.

3. The method of claim 1 wherein said vessel has a running angle when underway and said roof is sloped at an angle approximate to said running angle.

4. The method of claim 1 wherein said tunnel includes a protective plate extending between said side wall underneath said propeller.

5. The method of claim 4 wherein a circular duct is formed in said tunnel encircling said propeller.

6. The method of claim 1 including the step of providing a micro-step at the chute inlet, said micro-step temporarily separating water flow from said hull, said water flow reattaching to said hull toward said stem.

7. The method of claim 1 including the step of providing a curved chute inlet, said water flow being lifted above said running surface by said inlet.

* * * * *